United States Patent [19]

Fletcher

[11] 3,981,498

[45] Sept. 21, 1976

[54] NON-UNIFORM CHARGING OF SHEET MATERIAL

[75] Inventor: Gerald M. Fletcher, Pittsford, N.Y.

[73] Assignee: Xerox Corporation, Stamford, Conn.

[22] Filed: Mar. 24, 1975

[21] Appl. No.: 561,459

[52] U.S. Cl. ..... 271/193; 226/94; 355/3 R

[51] Int. Cl.[2] ..... B65H 29/16

[58] Field of Search ..... 271/DIG. 3, 18.1, 193, 271/275; 226/94; 355/3 R, 3 TR, 3 CH; 317/262 E

[56] References Cited

UNITED STATES PATENTS

| | | | |
|---|---|---|---|
| 2,576,882 | 11/1951 | Koole et al. | 271/DIG. 3 |
| 3,172,657 | 3/1965 | Brandt | 271/193 |
| 3,351,340 | 11/1967 | Levine | 271/193 |
| 3,795,441 | 3/1974 | Hoffman et al. | 355/3 R |
| 3,846,020 | 11/1974 | Fletcher | 271/DIG. 3 |

OTHER PUBLICATIONS

Scharf, Def. Pub. of Ser. No. 872573 filed 10-30-69.

*Primary Examiner*—Evon C. Blunk
*Assistant Examiner*—Robert Saifer

[57] ABSTRACT

A roller having an outer textured cylindrical surface applies, by means of a constant current, a non-uniform charge pattern over the surface of a sheet of material such as, for example, sheets of paper or plastic as used in xerographic transparencies and/or over the surface of a conveying structure, such as a conveying belt, which moves the sheet material to, through, and/or beyond a xerographic transfer zone. The charge applied over the sheet material is of a polarity opposite to that of the charge applied to the conveying structure so that an electrostatic tacking force holds the sheet material on or adheres the sheet material to the conveying structure. Preferably the charge is applied over the surfaces of the sheet material and conveying structure which face each other.

11 Claims, 4 Drawing Figures

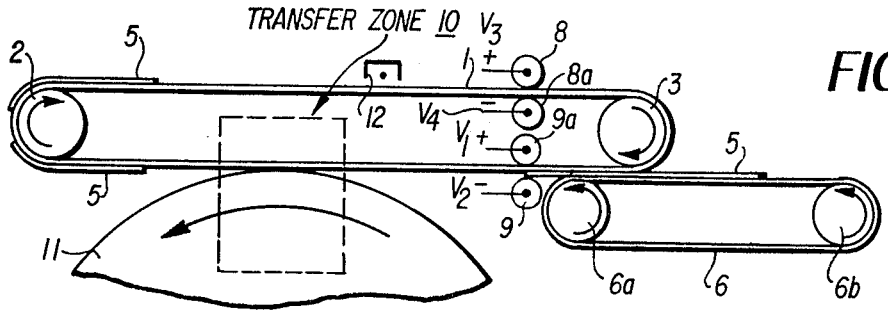
FIG. 1
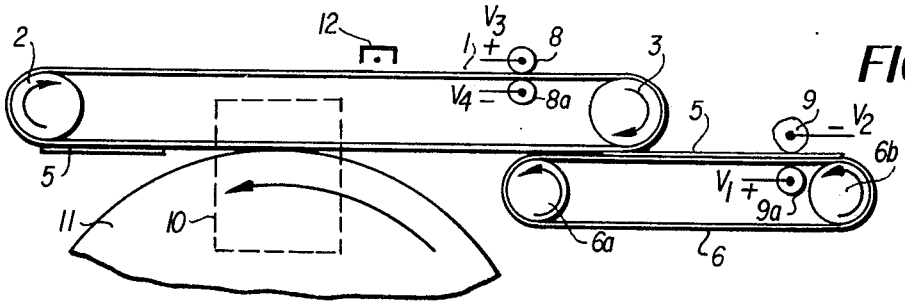
FIG. 2
FIG. 3A
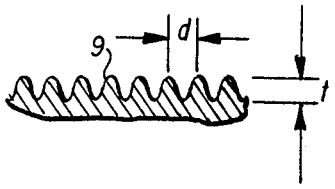
FIG. 3
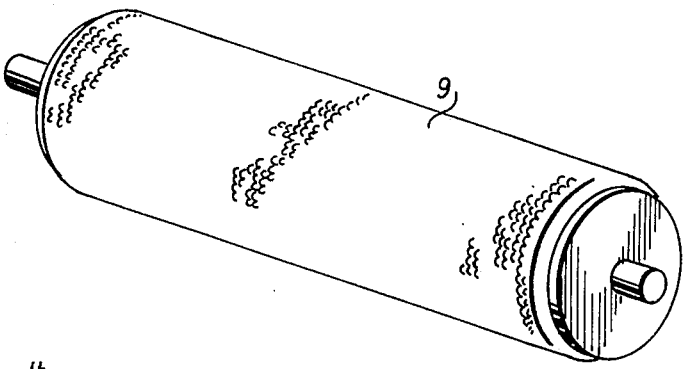
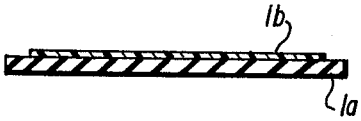
FIG. 4

NON-UNIFORM CHARGING OF SHEET MATERIAL

BACKGROUND OF THE INVENTION

1. Field of the Invention

This invention relates to a paper sheet transport system in which sheet material, for example, in the form of sheets of paper or plastic, as in xerographic transparencies, is electrostaticly tacked to a conveying structure usually in the form of a conveyor belt. In systems of this type, it is desirable to hold the sheet material on the conveying structure with the largest electrostatic tacking force possible so that the sheet material is held on or adhered to the conveying structure as strongly as possible.

2. Description of the Prior Art

In the prior art, it is known to electrostatically tack a sheet of paper to a conveying belt by applying a charge to the surface of the paper with a polarity opposite to that of the charge applied to the conveyor belt. The charge is conventionally applied to the paper through a roller having a smooth outer cylindrical surface. Therefore, the charge applied to the paper is generally uniform throughout the entire surface area of the paper sheet. U.S. Pat. No. 2,576,882 to Koole et al. is an example of one such prior art device.

SUMMARY OF THE INVENTION

In this invention, the charge applied over the surface of the sheet material or conveying structure is applied by means of a roller having a textured outer cylindrical surface. It has been determined that, for a constant total charge, increased electrostatic forces are generated if the surface of the paper and/or conveying structure which is charged has a non-uniform charge pattern applied thereover rather than a uniform charge. By means of this invention, a non-uniform charge can be applied to the surface of the sheet material and/or the surface of the conveying belt and then, as noted above, increased electrostatic tacking forces are obtained so that the sheet material is more strongly held on or adhered to the conveying structure. The charge may be applied over the surface of the sheet material and/or conveying structure by means of a constant current so as to produce a constant average sheet material total charge independent of the resistivity and thickness, both of which may vary from sheet to sheet, of the sheet material.

By means of this invention, considerably higher electrostatic tacking forces between the sheet material and the conveying structure can be obtained than are obtainable in the devices of the prior art.

An object of this invention is to electrostatically tack sheets of material to a conveying structure with higher electrostatic tacking forces so that the sheets are more firmly held on or adhered to the conveying structure.

A further object of this invention then is to provide a non-uniform charge pattern over the surface of a sheet of a sheet of material and/or over the surface of a conveying structure so that higher electrostatic forces between the sheet material and the conveying structure can be obtained.

A further object of the invention is to provide a roller, the outer cylindrical surface of which is textured, through which the non-uniform charge pattern is applied over the surface of the sheet material and/or over the surface of the conveying structure.

A further object of the invention is to apply the non-uniform charge over the surface of the sheet material and/or over the surface of the conveying structure by means of a constant current so as to obtain a constant average sheet material total charge which is independent of the resistivity and thickness of the sheet material.

A further object of the invention is to electrostatically tack sheets of material to a conveying structure with substantially the same electrostatic tacking force regardless of the resistivity and thickness, both of which may vary from sheet to sheet, of the sheets.

A still further object of the invention is to provide a non-uniform charge pattern over the surface of the sheet material which faces the belt to thereby minimize printout of the non-uniform charge pattern on the output copy during transfer.

BRIEF DESCRIPTION OF THE DRAWINGS

FIG. 1 is a longitudinal cross-sectional view through a first embodiment of the apparatus showing the belt as well as the cylinders for driving it and the rollers for charging the paper and the belt.

FIG. 2 is a view similar to FIG. 1 showing another embodiment of the apparatus in which the surface of the paper which faces the belt is charged.

FIG. 3 is a perspective view of the roller, with the grooves therein shown on an enlarged scale, which charges the surface of the paper sheet.

FIG. 3A is an enlarged cross-sectional view of a portion of the periphery of the roller.

FIG. 4 is a transverse cross-sectional view of an advantageous embodiment of the belt, usable with the embodiments of FIGS. 1 and 2, having a conductive coating thereon.

DETAILED DESCRIPTION OF THE PREFERRED EMBODIMENTS

In FIG. 1 is shown a first embodiment of the invention which includes a dielectric belt 1 driven by rollers 2 and 3. The belt may also have a conductive coating **1*b*, as shown in FIG. 4, on the inner run thereof. Individual sheets of material 5 are fed to the belt 1 from, for example, another conveyor belt 6 driven by rollers 6*a* and 6*b*. The sheets of material 5** may be made, for example, of paper or plastic, as used in xerographic transparencies.

Each sheet 5 passes through a xerographic transfer zone 10, including a photoconductor 11, to and from which the sheets 5 are carried by the belt 1. As is known in the xerographic paper handling art, it is desirable that the sheets being fed to, through, and/or beyond a xerographic transfer zone be held as strongly as possible to the belt or conveying mechanism by which they are being moved. As noted above, it is conventional that the sheets be electrostatically tacked or adhered to the belt. In this invention, above the upper run of the conveyor belt 1 is positioned a conductive roller 8 and below the upper run is positioned a conductive roller **8*a*. The roller 8 is connected to the positive terminal of a source of direct-current voltage $V_3$ and the roller 8*a* is connected to the negative terminal of a source of direct-current voltage $V_4$. During operation the voltage $(V_3 - V_4)$ produces a current through the conductive roller 8 which deposits a positive charge on the belt 1**.

Another roller 9 is positioned below and spaced from the lower run of the belt 1 so as to be in rolling contact with a sheet of paper 5 to be moved between the roller 9 and the lower run of the belt 1. Above the lower run is a roller 9*a*. As shown in FIGS. 3 and 3A, the roller 9 has a generally cylindrical outer surface which is textured. The roller 9 is connected to a negative terminal of a source of direct-current voltage $V_2$ and the roller 9*a* is connected to the positive terminal of a source of direct-current voltage $V_1$. During operation the voltage $(V_1 - V_2)$ produces a current through the conductive roller 9 which deposits a negative charge on the sheet 5.

By reason of the polarity difference between the charge deposited on the belt 1 and the charge deposited on the sheet 5, an electrostatic tacking force is produced between them which holds or adheres the sheet 5 on the belt 1.

In operation, with all of the rollers and the photoreceptor rotatably driven in the direction shown by the arrows in FIG. 1, individual sheets 5 of material are first fed, by any means onto a conveyor belt 6. The sheets are then fed, by belt 6, into the space between roller 9 and the lower run of belt 1. While the roller 8 applies a charge to conveyor belt 1, the roller 9 applies the non-uniform charge pattern of opposite polarity over the surface of each sheet 5 moving therepast so that an electrostatic force is produced which holds the sheets 5 on or adheres them to conveying belt 1. The sheets 5 are then carried by the belt 1 through the transfer zone 10, including the photoreceptor 11, for subsequent processing of the sheets. The toner may be transferred to the sheet from the photoreceptor surface in the transfer zone by any of the known techniques.

Also in this invention it is contemplated that the roller 8 may have an outer cylindrical textured surface, like that of the roller 9, so that a non-uniform charge pattern is deposited on the outer surface (outer run) of the belt 1. In this feature of the invention, the charge pattern applied to the surface of the sheet 5 may be uniform or non-uniform. In either case, the desired increased electrostatic tacking forces between the sheet and the belt will be obtained. A.C. corotron 12, as shown in FIG. 1, should be provided upstream of the roller 8. The corotron 12 functions to neutralize the charge pattern remaining on the surface of the belt 1 prior to the application of the non-uniform charge pattern over that surface by the roller 8. Likewise an additional corotron could be provided below the upper run of the belt 1.

A second embodiment of the invention is shown in FIG. 2. In FIG. 2 identical reference numerals have been used to denote the identical parts shown in the embodiment of FIG. 1. In this embodiment, the textured conductive roller 9 is positioned above and spaced from the upper run of the belt 6 and a roller 9*a* is positioned below the upper run. The roller 9 is again connected to the negative terminal of the source of direct-current voltage $V_2$ and the roller 9*a* is connected to the positive terminal of a source of direct-current voltage $V_1$. During operation, the voltage $(V_1 - V_2)$ produces a current through the conductive roller 9 which deposits a non-uniform negative charge pattern on that surface. In this embodiment, the surface of the sheet which faces belt 1 is charged. Therefore, since the charged surface of the paper is further away from the photoconductor 11, printout of the non-uniform charge patterns on the sheet 5 less likely to occur at the transfer zone 10 than with the first embodiment in which the surface of the sheet which faces the photoconductor 11 is charged. Alternatively, the roller 9*a* could be eliminated if the underside belt 6 were conductive and rollers 6*a* and 6*b* connected to the voltage source $V_1$.

In the operation of the FIG. 2 embodiment, with all of the rollers and the photoreceptor rotatably driven in the direction shown by the arrows, the sheets 5 of material are first fed, by any means, onto the conveyor belt 6. The sheets then move beneath roller 9 and it applies a non-uniform charge pattern over the upper surface of each sheet. The sheets are then further fed to the conveyor belt 1 and, since the roller 8 applies a charge of opposite polarity to the conveyor belt 1, are held on or adhered to the belt 1 by the electrostatic tacking force resulting from the polarity difference between the charge on the sheet and the charge on the belt. The sheets 5 are then carried by the belt 1 through the transfer zone 10, including the photoreceptor 11, for subsequent processing of the sheets.

As in the FIG. 1 embodiment, it is also contemplated in the FIG. 2 embodiment of the invention, that the roller 8 may have an outer cylindrical textured surface, like that of the roller 9 so that a non-uniform charge pattern is deposited on the outer run of the belt 1. Again, as in the FIG. 1 embodiment, the charge pattern applied to the surface of the sheet 5 may be uniform or non-uniform as, in either case, the desired increased electrostatic tacking forces between the sheet and the belt will be obtained. Likewise, as in FIG. 1, an A.C. corotron 12 should be positioned upstream of the roller to neutralize the charge pattern remaining on the surface of the belt 1 prior to the application of the non-uniform charge pattern over that surface by the roller 8 and an additional A.C. corotron could be provided below the upper run of the belt 1.

As noted above, either or both of the rollers 8 and 9 may have their outer cylindrical surface textured. In FIGS. 3 and 3A, only the roller 9 is shown in detail. However it is to be understood that the roller 8, when textured, would be substantially identical to the roller 9.

As shown in FIG. 3, the surface of the roller 9 is textured. More specifically, with reference to FIG. 3A, the periphery of the roller 9 includes a continuous array of alternating peaks or raised projections and grooves or valleys with the grooves or valleys extending circumferentially and axially of the roller 9. The distance *d* between adjacent peaks or raised projections is advantageously between 4 to 10 mils and the depth *t* of the grooves or valleys is advantageously between 2 to 4 mils. The specific structure of the textured surface of the roller 9 and/or roller 8 is to provide the non-uniform charge pattern over the surface of the sheet and/or the conveyor belt 1 respectively. Because the surface of the roller 9 and/or 8 is textured, it deposits non-uniform charge pattern over the sheet and/or conveyor belt respectively. If the roller were smooth, as in the prior art, then a substantially uniform charge pattern would be provided over the surface of the sheet. As described above, it has been found that when a non-uniform charge is provided over the surface of the sheet and/or the surface of the conveyor belt substantially higher electrostatic forces are obtained between the sheet and the belt so that the sheet is more firmly held on or adhered to the belt 1.

It is desirable that a constant current be applied to the sheet 5 and/or conveyor belt 1 through the textured conductive roller 9 and/or 8 so that a constant average total charge is applied to each sheet and/or belt. This total charge is completely independent of the resistivity or thickness of the paper so that all sheets, regardless of their differing resistivities and thicknesses, receive the same average charge density. While the application of a constant current is not essential to the invention, it is advantageous because, with a constant current applied, the voltage will adjust itself in response to the different resistivities and thicknesses of the sheets of material, to apply substantially the same amount of the total charge non-uniformily over the sheet and/or belt.

The charging of the sheets and/or belt can be caused by direct charge injection, i.e. the outer textured surface of the roller actually contacts the sheets and/or belt and deposits charge in these regions. This charging may also be effected by both triboelectric charging, caused by the contact of the peaks or raised projections with the surface of the sheets 5 and/or belt 1, and air ionization in the portions of the roller immediately surrounding the peaks or raised projections. Concerning the latter, due to a dependence of air ionization on the depth *t* of the grooves of the roller 9 and, to a lesser extent on the distance *d* between next adjacent raised portions on the roller 9, if the depth *t* is sufficiently large, for example 4 mils, the electrostatic field in the grooves can be made sufficiently small to prevent any air ionization in the valleys even though air ionization may occur near the peaks. Although not necessary, it is also contemplated in this invention that the roller 9 and/or roller 8 may be spaced a distance of, for example ½ mil, from the surface of each sheet and/or belt respectively to be charged, so that the non-uniform charge over the surface of the sheet and/or belt is effected solely by air ionization and not by direct contact charging.

The non-uniform charge pattern on the surface of the sheet of paper or other material, such as plastic, as well as the non-uniform charge pattern on the surface of the belt 1 may relax or dissipate along the surface thereof into that of a substantially uniform charge pattern.

It is desirable that about not more than one half of the non-uniform charge pattern on the surface be dissipated so that the higher electrostatic tacking forces can be maintained. The time for about one half the non-uniform charge pattern on the surface to be dissipated is proportional to the lateral surface resistivity of the surface material. By way of example only, one second has been found to be sufficient time to charge the surface, be it the surface of the belt 1 or sheet 5 or both, and convey the sheet 5 to, through and beyond the transfer zone 10 for any necessary subsequent processing and yet maintain the desired increased tacking force. Assuming a time of one second for about one half the non-uniform charge pattern on the surface to be dissipated, the lateral surface resistivity of the material should be at least about $3 \times 10^{14}$ ohms/sq.

As most in-ream papers have resistivities less than $10^{13}$ ohms/sq and assuming a minimum process time of one second is desired, their resistivity should be increased to prevent any substantial dissipation of the non-uniform charge pattern. This increase can be accomplished with most types of paper by decreasing its moisture content, for example, by providing a drier which dries the paper before its surface is charged. By such drying the desired resistivity of most papers can be increased to a value greater than $3 \times 10^{14}$ ohms/sq. As most plastic sheet has high lateral surface resistivity, i.e. above $3 \times 10^{14}$ ohms/sq., dissipation of the non-uniform charge pattern thereon is not troublesome for a one second process time. Likewise, the outer run of the belt 1 which faces and contacts the sheet material should be a good dielectric and have a lateral surface resistivity of at least about $3 \times 10^{14}$ ohms/sq. to prevent lateral surface charge flow which would level the non-uniform charge pattern thereon into a substantially uniform charge pattern. The outer run at least of the belt 1 can therefore be made of any known material having these characteristics. The particular belt material having these characteristics would be evident to persons skilled in the art.

It is apparent from the above that if the process time was greater than one second, the lateral surface resistivity of the material should be correspondingly higher than $3 \times 10^{14}$ ohms/sq. and if the process time was less than one second, the lateral surface resistivity could be correspondingly lower than $3 \times 10^{14}$ ohms/sq.

By means of this invention, for a constant total charge, considerably higher electrostatic tacking forces are obtainable between the paper and the belt than are obtainable in the prior art so that, with this invention, sheet material, such as sheets of paper, may be more strongly held on or adhered to the surface of the conveying mechanism.

I claim:

1. In a sheet material conveying apparatus having a conveying surface for conveying sheet material, the improvement comprising:

means for applying a non-uniform charge pattern over said conveying surface, and means for applying a non-uniform charge pattern of opposite polarity over a surface of the sheet material being conveyed whereby an electrostatic tacking force holds the sheet material on the conveying surface, wherein both of said means comprises a roller having an outer cylindrical surface which is textured substantially throughout.

2. A sheet material conveying apparatus as claimed in claim 1, wherein:

the outer substantially cylindrical textured surface of said roller comprises a plurality of grooves defined therein with a plurality of raised projections therebetween, and the depth of said grooves is between 2 to 4 mils and next adjacent ones of said projections are positioned at a distance of between 4 to 10 mils from each other.

3. A sheet material conveying apparatus as claimed in claim 2, wherein:

said grooves in said roller extend circumferentially thereabout and axially thereof.

4. A sheet material conveying apparatus as claimed in claim 1 wherein at least one of said means for applying a non-uniform charge pattern comprises a source of constant current.

5. A sheet material conveying apparatus as claimed in claim 1 wherein the surface of the sheet material which is charged faces the conveying surface.

6. A sheet material conveying apparatus as claimed in claim 1 further comprising an endless conveyor belt, and wherein said conveying surface is the outer run of said conveyor belt.

7. Apparatus for electrostatically tacking a sheet of material to a conveying surface comprising:

means for applying a non-uniform charge pattern over the conveying surface through the outer textured surface of a substantially cylindrical roller for non-uniformly charging the conveying surface, and means for applying a non-uniform charge pattern of opposite polarity over a surface of the sheet of material through the outer textured surface of a substantially cylindrical roller for non-uniformly charging the surface of the sheet whereby an electrostatic tacking force will hold the sheet material on the conveying surface.

8. In a sheet material conveying apparatus having a conveying belt with a dielectric surface for transporting a sheet of material through a xerographic transfer zone with said sheet of material electrostatically adhered to said belt, the improvement comprising means for non-uniformly charging said belt prior to said belt transporting said sheet of material through said transfer zone to improve said electrostatic adhering of said sheet of material to said belt, wherein said non-uniform charging means comprises a roller connected to a constant current charging current source, said roller having an outer textured surface through which said dielectric surface of said belt is non-uniformly charged.

9. The apparatus of claim 7 wherein said outer textured surface of said roller is substantially cylindrical and has a plurality of grooves defined therein with a plurality of raised projections therebetween.

10. The apparatus of claim 9 wherein the depth of said grooves is between 2 to 4 mils and said projections are spaced apart between 4 to 10 mils.

11. A method of electrostatically tacking a sheet of material to a conveying surface comprising:

applying a non-uniform charge pattern over the conveying surface through the outer textured surface of a substantially cylindrical roller for non-uniformly charging the conveying surface, and applying a non-uniform charge pattern of opposite polarity over a surface of the sheet of material through the outer textured surface of a substantially cylindrical roller for non-uniformly charging the surface of the sheet whereby an electrostatic tacking force will hold the sheet material on the conveying surface.

* * * * *